US008832898B1

(12) United States Patent
Stimach

(10) Patent No.: US 8,832,898 B1
(45) Date of Patent: Sep. 16, 2014

(54) TWO-HANDED SCRAPING DEVICE

(71) Applicant: James J. Stimach, Bonney Lake, WA (US)

(72) Inventor: James J. Stimach, Bonney Lake, WA (US)

( * ) Notice: Subject to any disclaimer, the term of this patent is extended or adjusted under 35 U.S.C. 154(b) by 0 days.

(21) Appl. No.: 13/972,024

(22) Filed: Aug. 21, 2013

(51) Int. Cl.
*A47L 13/02* (2006.01)
*A47L 13/022* (2006.01)

(52) U.S. Cl.
CPC ..... *A47L 13/022* (2013.01); *A47L 13/02* (2013.01)
USPC ..... 15/236.01; 15/143.1; 15/245.1; 30/169

(58) Field of Classification Search
USPC ..... 15/236.01, 236.02, 236.05, 236.06, 15/143.1, 245; 30/169, 295, 164.7
See application file for complete search history.

(56) References Cited

U.S. PATENT DOCUMENTS

| | | | | |
|---|---|---|---|---|
| 157,162 | A | 11/1874 | Duncan et al. | |
| 1,082,952 | A | 12/1913 | Hobbs | |
| 1,550,894 | A | 8/1925 | Erickson | |
| 4,890,351 | A * | 1/1990 | Wilson | 15/236.1 |
| 4,984,324 | A | 1/1991 | Farris | |
| D479,374 | S | 9/2003 | Gringer et al. | |
| 6,629,331 | B2 | 10/2003 | Panfili et al. | |
| 6,871,377 | B2 * | 3/2005 | Veltrop et al. | 15/236.01 |
| 7,249,393 | B2 | 7/2007 | Marion et al. | |
| 7,665,390 | B2 * | 2/2010 | Hoffman | 81/22 |
| D615,262 | S | 5/2010 | Bunnag et al. | |
| 8,312,589 | B1 | 11/2012 | Thomas | |

* cited by examiner

*Primary Examiner* — Shay Karls

(57) ABSTRACT

A two-handed scraping device reduces strain caused by scraping by providing both front and rear handles. The device includes a main body having a front end and a back end. A front handle is coupled to and extends upwardly from the front end. A rear end of the front handle extends rearwardly toward the back end. A scraper blade is coupled to the front end and is configured for scraping against and removing material from a surface. A rear handle is coupled to and extends upwardly from the rear end. A front end of the rear handle extends forwardly toward the front handle.

20 Claims, 3 Drawing Sheets

TWO-HANDED SCRAPING DEVICE

BACKGROUND OF THE DISCLOSURE

1. Field of the Disclosure

The disclosure relates to handheld scraping devices and more particularly pertains to a new handheld scraping device for reducing strain caused by scraping by providing both front and rear handles.

2. Summary of the Disclosure

An embodiment of the disclosure meets the needs presented above by generally comprising a main body having a front end and a back end. A front handle is coupled to and extends upwardly from the front end. A rear end of the front handle extends rearwardly toward the back end. A scraper blade is coupled to the front end and is configured for scraping against and removing material from a surface. A rear handle is coupled to and extends upwardly from the rear end. A front end of the rear handle extends forwardly toward the front handle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
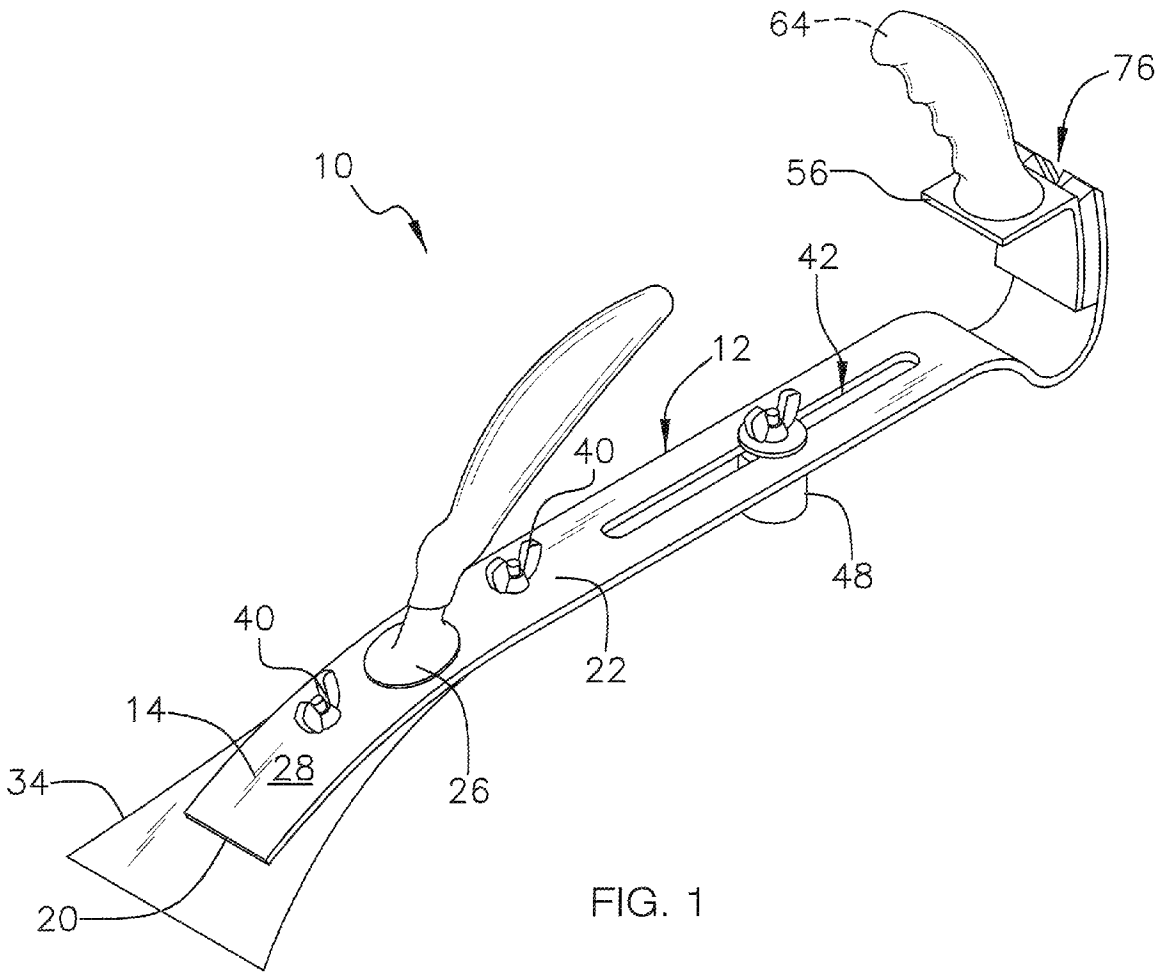
FIG. 1 is a top front side perspective view of a two-handed scraping device according to an embodiment of the disclosure.
Figure 2:
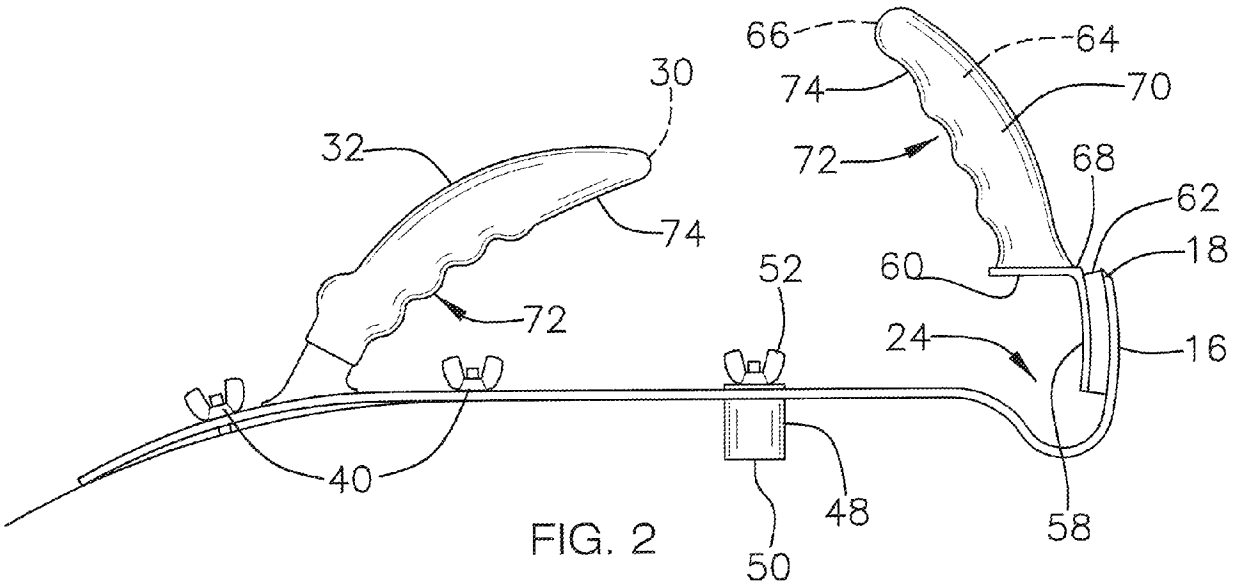
FIG. 2 is a side view of an embodiment of the disclosure.
Figure 3:
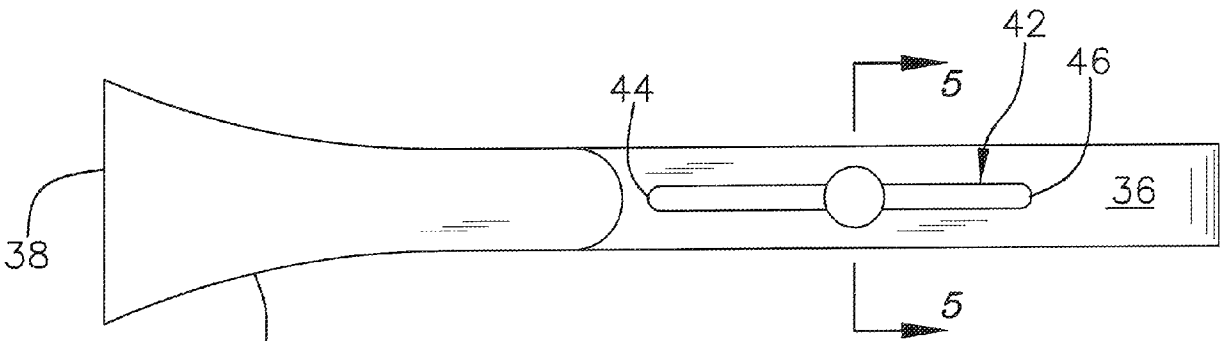
FIG. 3 is a bottom view of an embodiment of the disclosure.
Figure 5:
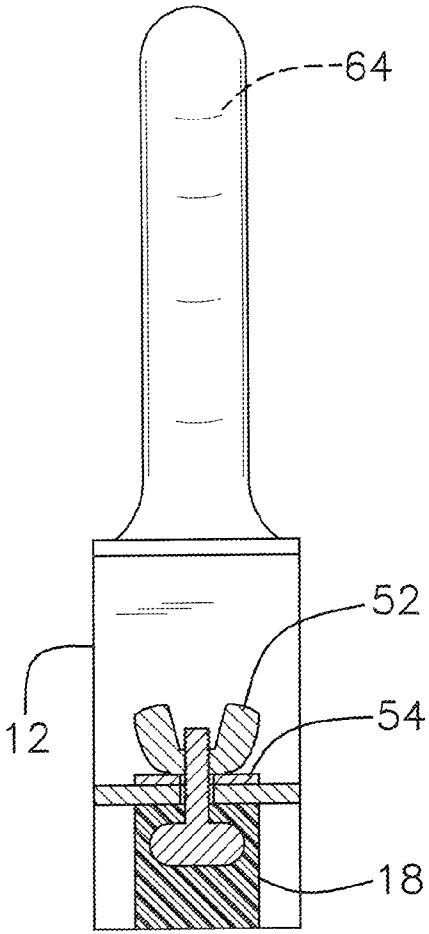
FIG. 5 is a cross-sectional view of an embodiment of the disclosure taken along line 5-5 of FIG. 3.
Figure 4:
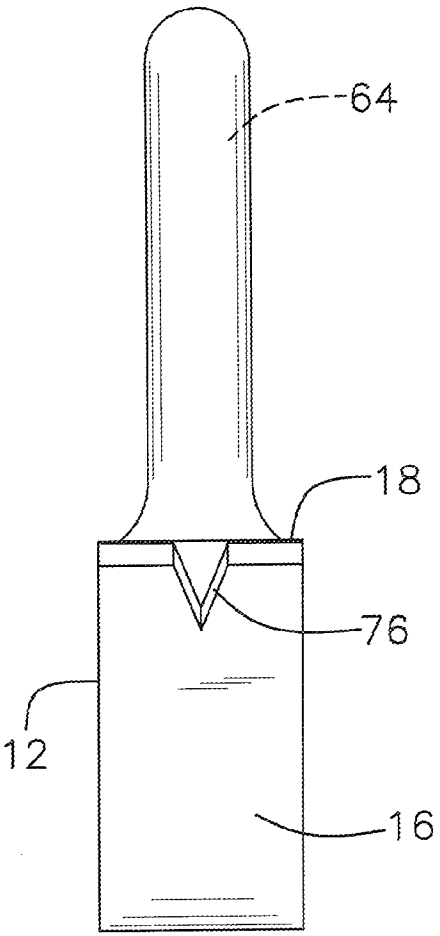
FIG. 4 is a back view of an embodiment of the disclosure.

With reference now to the drawings, and in particular to FIGS. 1 through 5 thereof, a new handheld scraping device embodying the principles and concepts of an embodiment of the disclosure and generally designated by the reference numeral 10 will be described.

As best illustrated in FIGS. 1 through 5, the two-handed scraping device 10 generally comprises a main body 12 having a front end 14, a back end 16, a first edge 18 and a second edge 20. The front end 14 of the main body 12 may be convexly arcuate such that the second edge 20 is positioned lower than a medial section 22 of the main body 12. The back end 16 of the main body 12 may form an arcuate depression 24 and extend upwardly therefrom such that the first edge 18 is elevated with respect to the medial section 22. The main body 12 may be rigid and constructed from steel or like material.

A front handle 26 is coupled to the main body 12. The front handle 26 is positioned on the front end 14. The front handle 26 extends upwardly from a first surface 28 of the main body 12. A rear end 30 of the front handle 26 extends rearwardly toward the back end 16 of the main body 12. A covering 32 may be positioned over the front handle 26. The covering 32 may be comprised of a resiliently compressible material, such as rubber or the like.

A scraper blade 34 is coupled to the front end 14. The scraper blade 34 may be couplable to a second surface 36 of the main body 12. The scraper blade 34 is configured for scraping against and removing material from a surface to be scraped. The scraper blade 34 may scrape and remove ice, vinyl, wood, paint, concrete, or the like. The scraper blade 34 has a front edge 38 extending outwardly from the front end 14 of the main body 12. The scraper blade 34 may taper outwardly toward the front edge 38. A pair of first fasteners 40, such as wing nuts or the like, may removably couple the scraper blade 34 to the second surface 36. In this manner, the scraper blade 34 can be replaced with any other blade and can be used to scrape virtually any type of surface. Depending on the particular scraping activity to be accomplished, the scraper blade 34 may be constructed from steel, vinyl, plastic, or the like.

A slot 42 is positioned in the main body 12 and extends through each of the first 28 and second 36 surfaces. The slot 42 may be longitudinally positioned between the front 14 and back 16 ends. The slot 42 may have arcuate ends 44, 46. A leveler 48 is positioned below the slot 42. A bottom end 50 of the leveler 48 is configured for abutting the surface to be scraped and ensuring that the main body 12 and the scraper blade 34 remain level with respect to the surface to be scraped. The leveler 48 may be constructed from vinyl, plastic, or the like. A second fastener 52, such as wing nuts or the like, may removably couple the leveler 48 to the main body 12. A washer 54 may be positioned on the first surface 28 above the leveler 48. The washer 54 is coupled to the second fastener 52 such that the washer 54, the second fastener 52 and the leveler 48 slide as a unit along a length of the slot 42.

A handle bracket 56 is coupled to the back end 16 of the main body 12. The handle bracket may be L-shaped wherein a first section 58 of the handle bracket 56 is coupled to the first surface 28 proximate the first edge 18 and a second section 60 extends outwardly from the first section 58 toward the front end 14. The handle bracket 56 may be constructed from aluminum or like material. A spacer 62 may be positioned between the handle bracket 56 and the first surface 28. The spacer 62 may be constructed from plastic, vinyl, or the like. A rear handle 64 is coupled to and extends upwardly from the rear end 16. A first end 66 of the rear handle 64 extends forwardly toward the front handle 26. The rear handle 64 is positioned on a top 68 of the second section 60 of the handle bracket 56. Each of the front 26 and rear 64 handles may be constructed from aluminum, rubber, plastic, or the like. A coating 70 may be positioned over the rear handle 64 and may cover an entirety of the rear handle 64. The coating 70 may be comprised of a resiliently compressible material, such as rubber or the like. A plurality of arcuate gripping portions 72 is coupled to each of the front handle 26 and the rear handle 64 and may be positioned on an underside 74 of each of the front handle 26 and the rear 64 handle.

A groove 76 is provided and may extend downwardly into the first edge 18 of the main body 12. The groove 76 is configured to extract nails when nails are positioned in and manipulated within the groove 76. The groove 76 may be v-shaped or have any other suitable shape to extract nails positioned therein.

The main body 12 may have a length between approximately 34.0 centimeters and 37.0 centimeters and a width between approximately 2.5 centimeters and 5.0 centimeters. The main body 12 may have a length between approximately 40.0 centimeters and 45.0 centimeters when the scraper blade 34 is attached to the main body 12. The slot 42 may have a length between approximately 13.0 centimeters and 17.0 centimeters and a width between approximately 0.5 centimeters and 3.0 centimeters. The leveler 48 may have each of a length and a width between approximately 2.5 centimeters and 5.0 centimeters.

In use, as stated above and shown in the Figures, a user grasps each of the front 26 and rear 64 handles simultaneously. The scraper blade 34 is positioned flush with respect to the surface to be scraped. The user then thrusts the device 10 against the surface to be scraped and in the process removes ice, paint, or the like from the surface. The scraper blade 34 can be removed and replaced with a different blade to accomplish a variety of scraping purposes. A head of a nail is positioned within the groove 76 in order to extract the nail after being fastened into a nailed surface.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A two-handed scraping device comprising:

a main body having a front end, a back end, a first edge and a second edge;

a front handle coupled to and extending upwardly from said front end, a rear end of said front handle extending rearwardly toward said back end of said main body;

a scraper blade coupled to said front end, said scraper blade being configured for scraping against and removing material from a surface to be scraped;

a rear handle coupled to and extending upwardly from said back end, a first end of said rear handle extending forwardly toward said front handle;

a slot positioned in said main body, said slot extending through each of a first surface and a second surface of said main body;

a leveler positioned below said slot, a bottom end of said leveler being configured for abutting the surface to be scraped and ensuring that said main body and said scraper blade remain level with respect to the surface to be scraped;

a fastener removably coupling said leveler to said main body; and a washer positioned on said first surface above said leveler, said washer being coupled to said fastener such that said washer, said fastener and said leveler slide as a unit along a length of said slot.

2. The device of claim 1, further comprising said front end of said main body being convexly arcuate such that said second edge is positioned lower than a medial section of said main body.

3. The device of claim 1, further comprising said back end of said main body forming an arcuate depression and extending upwardly therefrom such that said first edge is elevated with respect to a medial section of said main body.

4. The device of claim 1, further comprising said main body being rigid.

5. The device of claim 1, further comprising said front handle extending upwardly from a first surface of said main body.

6. The device of claim 1, further comprising:

a covering positioned over said front handle, said covering being comprised of a resiliently compressible material; and a coating positioned over said rear handle, said coating being comprised of a resiliently compressible material.

7. The device of claim 6, further comprising said coating covering an entirety of said rear handle.

8. The device of claim 1, further comprising said scraper blade being coupled to a second surface of said main body.

9. The device of claim 1, further comprising said scraper blade having a front edge extending outwardly from said front end of said main body, said scraper blade tapering outwardly toward said front edge.

10. The device of claim 1, further comprising:

said scraper blade being removably coupled to said front end; and a pair of fasteners removably coupling said scraper blade to a second surface of said main body.

11. The device of claim 1, further comprising said slot being longitudinally positioned between said front and back ends.

12. The device of claim 1, further comprising said slot having arcuate ends.

13. The device of claim 1, further comprising:

a handle bracket coupled to said back end of said main body, said handle bracket being L-shaped wherein a first section of said handle bracket is coupled to a first surface of said main body proximate said first edge and a second section extends outwardly from said first section toward said front end;

a spacer positioned between said handle bracket and said first surface; and wherein said rear handle is positioned on a top of said second section of said handle bracket.

14. The device of claim 1, further comprising a plurality of arcuate gripping portions coupled to each of said front handle and said rear handle, said gripping portions being positioned on an underside of each of said front handle and said rear handle.

15. The device of claim 1, further comprising a groove extending downwardly into said first edge of said main body, said groove being v-shaped and configured to extract nails when nails are positioned in and manipulated within said groove.

16. A two-handed scraping device comprising:

a main body having a front end, a back end, a first edge, and a second edge, said front end of said main body being convexly arcuate such that said second edge is positioned lower than a medial section of said main body, said back end of said main body forming an arcuate depression and extending upwardly therefrom such that said first edge is elevated with respect to said medial section, said main body being rigid;

a front handle coupled to said main body, said front handle being positioned on said front end, said front handle extending upwardly from a first surface of said main body, a rear end of said front handle extending rearwardly toward said back end;

a covering positioned over said front handle, said covering being comprised of a resiliently compressible material;

a scraper blade removably coupled to said front end, said scraper blade being couplable to a second surface of said main body, said scraper blade being configured for scraping against and removing material from a surface, said scraper blade having a front edge extending outwardly from said front end of said main body, said scraper blade tapering outwardly toward said front edge;

a pair of first fasteners removably coupling said scraper blade to said second surface;

a slot positioned in said main body, said slot extending through each of said first and second surfaces, said slot being longitudinally positioned between said front and back ends, said slot having arcuate ends;

a leveler positioned below said slot, a bottom end of said leveler being configured for abutting the surface to be scraped and ensuring that said main body and said scraper blade remain level with respect to the surface to be scraped;

a second fastener removably coupling said leveler to said main body;

a washer positioned on said first surface above said leveler, said washer being coupled to said second fastener such that said washer, said second fastener and said leveler slide as a unit along a length of said slot;

a handle bracket coupled to said back end of said main body, said handle bracket being L-shaped wherein a first section of said handle bracket is coupled to said first surface proximate said first edge and a second section extends outwardly from said first section toward said front end;

a spacer positioned between said handle bracket and said first surface;

a rear handle coupled to and extending upwardly from said back end, a first end of said rear handle extending forwardly toward said front handle, said rear handle being positioned on a top of said second section of said handle bracket;

a coating positioned over said rear handle, said coating covering an entirety of said rear handle, said coating being comprised of a resiliently compressible material;

a plurality of arcuate gripping portions coupled to each of said front handle and said rear handle, said gripping portions being positioned on an underside of each of said front handle and said rear handle; and a groove extending downwardly into said first edge of said main body, said groove being v-shaped and configured to extract nails when nails are positioned in and manipulated within said groove.

17. A two-handed scraping device comprising:

a main body having a front end, a back end, a first edge and a second edge;

a front handle coupled to and extending upwardly from said front end, a rear end of said front handle extending rearwardly toward said back end of said main body;

a scraper blade coupled to said front end, said scraper blade being configured for scraping against and removing material from a surface to be scraped;

a rear handle coupled to and extending upwardly from said back end, a first end of said rear handle extending forwardly toward said front handle;

a handle bracket coupled to said back end of said main body, said handle bracket being L-shaped wherein a first section of said handle bracket is coupled to a first surface of said main body proximate said first edge and a second section extends outwardly from said first section toward said front end;

a spacer positioned between said handle bracket and said first surface; and wherein said rear handle is positioned on a top of said second section of said handle bracket.

18. The device of claim 17, further comprising said front handle extending upwardly from a first surface of said main body.

19. The device of claim 17, further comprising said scraper blade being removably coupled to said front end.

20. The device of claim 17, further comprising a groove extending downwardly into said first edge of said main body, said groove being v-shaped and configured to extract nails when nails are positioned in and manipulated within said groove.

* * * * *